US005842632A

United States Patent [19]

Van Hest

[11] Patent Number: 5,842,632

[45] Date of Patent: Dec. 1, 1998

[54] PACKAGING SLEEVE

[75] Inventor: Wilhelmus J. J. Van Hest, Eindhoven, Netherlands

[73] Assignee: U. S. Philips Corporation, New York, N.Y.

[21] Appl. No.: 942,679

[22] Filed: Oct. 2, 1997

Related U.S. Application Data

[63] Continuation of Ser. No. 798,681, Feb. 12, 1997, abandoned.

[30] Foreign Application Priority Data

Feb. 14, 1996 [EP] European Pat. Off. ..... 96200361

[51] Int. Cl.[6] ..... B65D 5/42

[52] U.S. Cl. ..... 229/153; 206/806; 229/164

[58] Field of Search ..... 229/153, 160, 229/164; 206/806

[56] References Cited

U.S. PATENT DOCUMENTS

| | | | |
|---|---|---|---|
| 1,956,642 | 5/1934 | Einson | 206/806 |
| 2,979,192 | 4/1961 | Blonder | 206/806 |
| 3,814,303 | 6/1974 | Smith | 206/806 |
| 3,985,232 | 10/1976 | Johnson | 229/153 |
| 4,146,128 | 3/1979 | Hogg et al. | 206/806 |
| 4,291,807 | 9/1981 | Giordano et al. | 229/164 |
| 4,308,986 | 1/1982 | Parrilli | 206/806 |
| 4,949,845 | 8/1990 | Dixon | 206/806 |
| 5,474,183 | 12/1995 | Warren et al. | 206/806 |
| 5,480,090 | 1/1996 | Taddei et al. | 206/806 |
| 5,566,831 | 10/1996 | Swenson | 206/806 |

FOREIGN PATENT DOCUMENTS

| | | |
|---|---|---|
| 035910A1 | 9/1981 | European Pat. Off. . |
| 0640531A1 | 3/1995 | European Pat. Off. . |
| 2248704 | 5/1975 | France . |

*Primary Examiner*—Gary E. Elkins
*Attorney, Agent, or Firm*—F. Brice Faller

[57] ABSTRACT

The packaging sleeve has at a first end (4) thereof an extended (11) back wall (1) and extended (31) side walls (3) connected thereto. The sleeve is closed at the first end (4) by a lid (21) connected to the front wall (2) and provided with a closing flap (23) which extends into the sleeve and is kept enclosed by side flaps (33), which extend from the side walls (3) and which are overlapped by the closing flap (23). The extended (11, 31) walls (1, 3) prevent the closing flap (23) from being opened, unless the sleeve may be damaged or destructed.

7 Claims, 2 Drawing Sheets

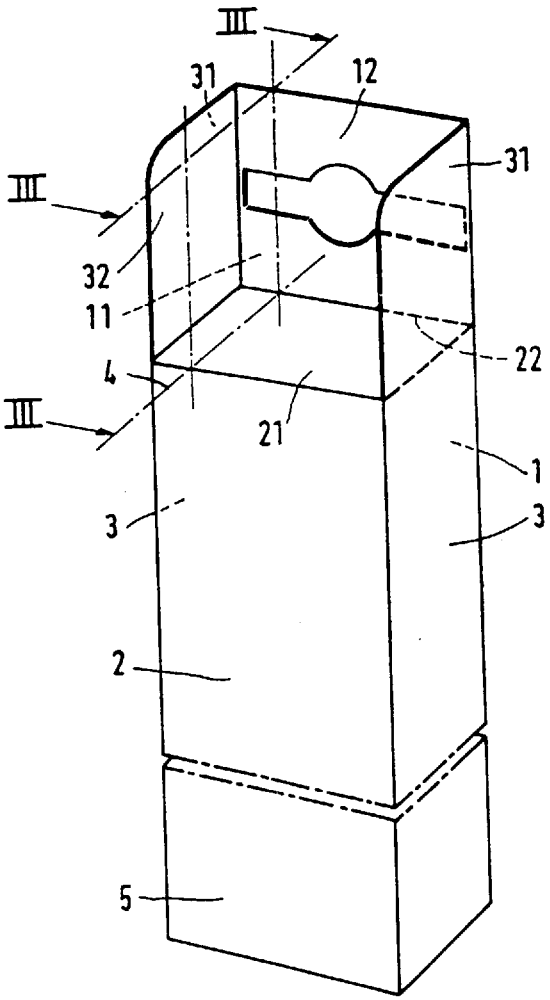
FIG.1
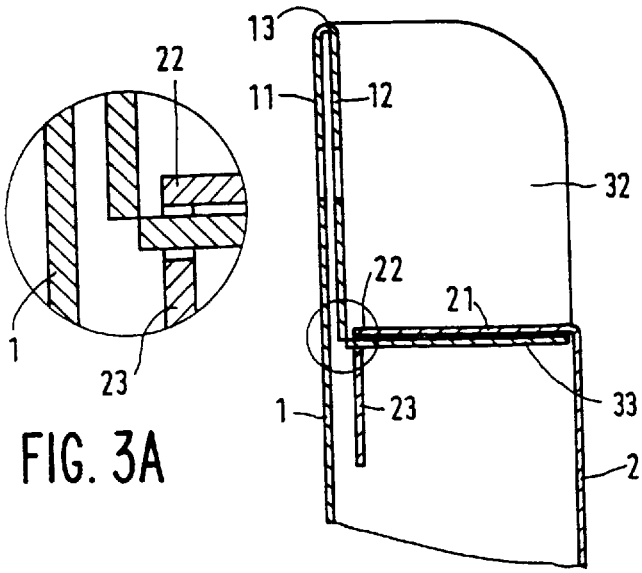
FIG. 3A
FIG.3

PACKAGING SLEEVE

This is a continuation division of application Ser. No. 08/798,681, filed Feb. 12, 1997, now abandoned.

BACKGROUND OF THE INVENTION

The invention relates to a packaging sleeve comprising:

a rear wall and a front wall;

mutually opposed side walls interconnecting the rear wall and the front wall, which sleeve has a first and a second end, the rear wall and the side walls having respective extensions at the first end, which extensions are mutually connected, project beyond the front wall, and are double-walled.

Such a packaging sleeve is known from EP-A-0 640 531.

The known packaging sleeve is open at its second end. The double-walled extension of the rear wall comprises lateral strips inside the sleeve which are passed around the object packed in the sleeve and are interconnected so as to form a strap for this object. The sleeve itself is not formed from the blank until after the strap has been closed. The sleeve is indetachably fixed in shape by means of tags at a wall which project through slots into the interior of the sleeve.

The known sleeve is suitable only for packaging an object which has a widened portion which is incapable of passing through the strap and is obstructed thereby.

The sleeve also has the disadvantage that it can only be formed from the blank in the presence of the object to be packed if this object has two widened portions between which the strap is to be applied. It is also disadvantageous that many operations are to be performed in the presence of the object.

Another disadvantage is that an object having only one widened portion can be removed from the sleeve without damaging the sleeve or even the necessity of opening the sleeve.

There is a demand, however, for a packaging sleeve which cannot be opened without the opening operation leaving traces on the sleeve. An undamaged packaging sleeve in that case guarantees that the object displayed on the sleeve is actually present.

SUMMARY OF THE INVENTION

It is an object of the invention to provide a packaging sleeve of the kind described in the opening paragraph which bears visible marks when it has been opened, and more in particular such a packaging sleeve which does not impose high requirements on the shape of an object which is to be held packaged therein.

According to the invention, this object is achieved in that at the first end of the sleeve:

the front wall has a lid which closes the sleeve and which is integrally connected along a fold to a closing flap which enters the sleeve, and the side walls have side flaps which are covered by the lid and which confine the closing flap, the walls of the sleeve are permanently interconnected, and the second end of the sleeve is permanently closed.

Owing to the extensions of the rear wall and the side walls, the lid is not accessible to the nail of a finger directed transversely to the rear wall near the closing flap so as to open the lid without damage to said extensions, in contrast to a sleeve closed in a conventional manner. The side flaps confining the closing flap contribute to the reliability of the closure. The permanently interconnected walls, for example glued together, guarantee that the sleeve shape is maintained unless the sleeve is visibly damaged. The permanently closed second end guarantees that the object cannot be removed through that end without leaving noticeable marks.

The sleeve has the advantage that it can be shaped from its blank, or from its flattened shape with walls already interconnected, before the object to be packed is present. The second end may close as it were automatically in that case if that end is provided with a pair of self-closing tags which are known per se. In that case, each of the walls has tags which are folded, for example, inward in the flattened sleeve and which are connected to only one adjoining flap so as to form a pair of self-closing flaps. With an object inside the sleeve, the latter can no longer assume its flat shape and the second end cannot be opened again. Alternatively, however, the second end may be permanently closed after shaping of the sleeve in that a flap at said end is permanently connected to the sleeve, for example with glue, or in that two or more flaps at said end are connected to one another.

In a favorable embodiment, the side flaps of the side walls are integral with the corresponding double walls of the extensions of the side walls at the first end of the sleeve. The sleeve may then be formed from one piece of material.

It is also advantageous when the double wall of the extension of the rear wall is connected to the extension of the rear wall along a fold, and the double walls of the extensions of the side walls are integral with the sleeve exclusively along a fold with the double wall of the extension of the rear wall. It is possible then to double over the double walls against the extensions themselves after the sleeve has been shaped, when the extension of the rear wall has come to enclose an angle with the extensions of the side walls. This is not the case in the known sleeve.

This embodiment renders it possible to close the second end of the sleeve first and only afterwards, with the object present in the sleeve, to close the second end without the side flaps hampering the insertion of the object at the first end.

It is favorable when the fold connecting the lid to the closing flap has an incision at either end. The closing flaps may then grip into these incisions when the sleeve is closed and thus fix the closing flap in the sleeve.

BRIEF DESCRIPTION OF THE DRAWINGS

An embodiment of the packaging sleeve according to the invention is shown in the drawing, in which FIG. 1 shows a sleeve in perspective view;

FIG. 3 is a cross-section taken on the line III—III in FIG. 1.

FIG. 3A is an enlargement of the circled area of FIG. 3.

DETAILED DESCRIPTION OF THE PREFERRED EMBODIMENTS

Figure 2:
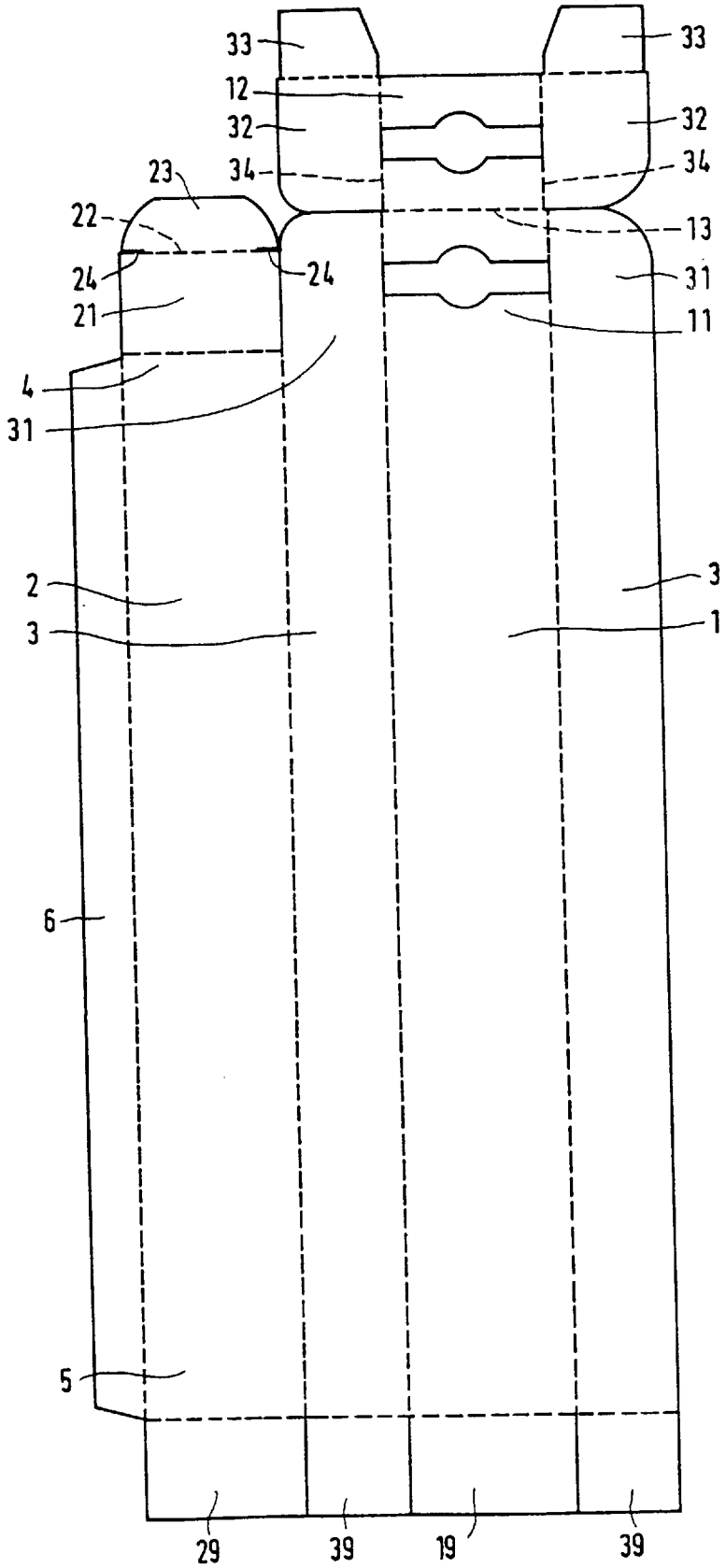
FIG. 2 shows the blank of the sleeve of FIG. 1.

The packaging sleeve of FIG. 1, see also the blank of FIG. 2, has a rear wall 1, a front wall 2, and mutually opposed side walls 3 which interconnect the rear wall 1 and the front wall 2. The sleeve has a first 4 and a second end 5. The rear wall 1 and the side walls 3 have respective extensions 11, 31 at the first end 4 which project beyond the front wall 2 and have double walls 12, 32.

At the first end 4 of the sleeve, the front wall 2 has a lid 21 which closes the sleeve and which comprises a closing flap 23, connected along a fold 22, which flap projects into the sleeve. The side walls 3 have side flaps 33 which are covered by the lid 21 and confine the closing flap 23. The walls 1, 2, 3 of the sleeve are permanently interconnected by means of an adhesive strip 6 in the embodiment drawn, see FIG. 2, which strip was adhered to a side wall 3 with glue, whereby a flat sleeve was created.

The second end 5 of the sleeve is permanently closed. This was done in FIG. 1 by means of flaps 19, 29, 39, see FIG. 2, of which the outermost ones 19, 29 were glued together.

The side flaps 33 of the side walls 3 at the first end 4 of the sleeve are integral with the corresponding double walls 32 of the extensions 31 of the side walls 3.

The double wall 12 of the extension 11 of the rear wall 1 is connected to the extension 11 of the rear wall 1 via a fold 13. The double walls 32 of the extensions 31 of the side walls 3 are integral with the sleeve only along a fold 34 to the double wall 12 of the extension 11 of the rear wall 1. As a result, the double walls 12, 32 can still be doubled over so as to form the fold 13 after the sleeve has been shaped.

The fold 22 connecting the lid 21 to the closing flap 23 has an incision 24 at either end. As a result, the side flaps 23 hook behind the closing flap 23, thus fixing the latter in the sleeve (FIG. 3 and FIG. 3A).

The extension 11 of the rear wall 1 achieves that the closing flap 23 is not accessible near the fold 22 to the nail of a finger directed transversely to the rear wall 1. The extensions 31 of the side walls 3 reinforce the extension 11 of the rear wall 1, so that the latter extension cannot be bent away. They also exclude the possibility of approaching the lid 21 from the side so as to pull it open. The sleeve cannot be opened at its first end 4 unless it is seriously deformed at this first end, for example torn.

The shape of the object to be packed in the sleeve is of little importance for the packing operation because the sleeve, like conventional sleeves, is closed at both ends.

A flat sleeve formed from the blank by means of the adhesive strip 6 may be readily formed into the finished sleeve in order to close the second end 5. After the insertion of the object, for example an electric lamp, the side flaps 33 can be folded back. The double walls 12, 32 may subsequently be doubled over about the folds 13, 34 so as to rest against the rear wall 1 and the side walls 3, respectively. Finally, the lid 21 with the closing flap 23 may be moved into position, with the result that the sleeve is permanently closed at the first end 4 without the use of an adhesive, and the sleeve can no longer be opened in a non-destructive manner.

I claim:

1. A packaging sleeve comprising:

a rear wall (1) and a front wall (2);

mutually opposed side walls (3) interconnecting the rear wall (1) and the front wall (2), which sleeve has a first (4) and a second end (5), the rear wall (1) and the side walls (3) having respective extensions (11, 31) at the first end (4), which extensions are mutually connected, project beyond the front wall (2), and are double-walled (12, 32), characterized in that at the first end (4) of the sleeve:

the front wall (2) has a lid (21) which closes the sleeve and which is integrally connected along a fold (22) to a closing flap (23) which enters the sleeve, and the side walls (3) have side flaps (33) which are covered by the lid (21) and which confine the closing flap (23), the walls (1, 2, 3) of the sleeve are permanently interconnected, and the second end (5) of the sleeve is permanently closed.

2. A packaging sleeve as claimed in claim 1, characterized in that the side flaps (33) of the side walls (3) are integral with the corresponding double walls (32) of the extensions (31) of the side walls (3) at the first end (4) of the sleeve.

3. A packaging sleeve as claimed in claim 2, characterized in that the fold connecting the lid to the closing flap has an incision at either end.

4. A packaging sleeve as claimed in claim 2, characterized in that the double wall (12) of the extension (11) of the rear wall (1) is connected to the extension (11) of the rear wall (1) via a fold, and the double walls (32) of the extensions (31) of the side walls (3) are integral with the sleeve only via a fold (34) with the double wall (12) of the extension (11) of the rear wall (1).

5. A packaging sleeve as claimed in claim 4, characterized in that the fold (22) connecting the lid (21) to the closing flap (23) has an incision (23) at either end.

6. A packaging sleeve as claimed in claim 1, characterized in that the double wall of the extension of the rear wall is connected to the extension of the rear wall via a fold, and the double walls of the extensions of the side walls are integral with the sleeve only via a fold with the double wall of the extension of the rear wall.

7. A packaging sleeve as claimed in claim 1, characterized in that the fold connecting the lid to the closing flap has an incision at either end.

* * * * *